US008308318B2

(12) United States Patent
Maxik

(10) Patent No.: US 8,308,318 B2
(45) Date of Patent: Nov. 13, 2012

(54) SUSTAINABLE OUTDOOR LIGHTING SYSTEM

(75) Inventor: Fredric S. Maxik, Indialantic, FL (US)

(73) Assignee: Lighting Science Group Corporation, Westampton, NJ (US)

( * ) Notice: Subject to any disclaimer, the term of this patent is extended or adjusted under 35 U.S.C. 154(b) by 544 days.

(21) Appl. No.: 12/434,417

(22) Filed: May 1, 2009

(65) Prior Publication Data

US 2010/0277097 A1 Nov. 4, 2010

(51) Int. Cl.
*F21S 8/08* (2006.01)
*F21S 10/00* (2006.01)
*E01F 9/04* (2006.01)

(52) U.S. Cl. ..... 362/231; 362/276; 362/802; 362/153.1

(58) Field of Classification Search ..... 362/84, 362/231, 276, 802, 249.02, 153.1
See application file for complete search history.

(56) References Cited

U.S. PATENT DOCUMENTS

| | | | | |
|---|---|---|---|---|
| 5,963,192 | A | 10/1999 | Wong et al. | |
| 6,149,283 | A | 11/2000 | Conway et al. | |
| 6,150,774 | A | 11/2000 | Mueller et al. | |
| 6,250,774 | B1 * | 6/2001 | Begemann et al. | 362/231 |
| 6,598,996 | B1 | 7/2003 | Lodhie | |
| 6,601,984 | B2 | 8/2003 | Yamamoto et al. | |
| 6,676,279 | B1 | 1/2004 | Hubbell et al. | |
| 6,705,744 | B2 | 3/2004 | Hubbell et al. | |
| 6,774,916 | B2 | 8/2004 | Pettitt et al. | |
| 6,811,258 | B1 | 11/2004 | Grant | |
| 6,906,852 | B1 | 6/2005 | Russell | |
| 7,014,336 | B1 * | 3/2006 | Ducharme et al. | 362/231 |
| 7,046,160 | B2 * | 5/2006 | Pederson et al. | 340/815.45 |
| 7,093,956 | B2 | 8/2006 | Miller et al. | |
| 7,095,056 | B2 | 8/2006 | Vitta et al. | |
| 7,688,222 | B2 * | 3/2010 | Peddie et al. | 340/905 |
| 7,759,854 | B2 | 7/2010 | Miller et al. | |
| 7,777,166 | B2 | 8/2010 | Roberts | |
| 7,850,321 | B2 * | 12/2010 | Wang et al. | 362/84 |
| 7,850,335 | B2 | 12/2010 | Hsu et al. | |
| 7,909,479 | B2 * | 3/2011 | Rooymans | 362/231 |
| 7,942,537 | B2 * | 5/2011 | Krijn et al. | 362/19 |
| 7,972,030 | B2 | 7/2011 | Li | |
| 8,021,021 | B2 | 9/2011 | Paolini | |
| 8,025,421 | B2 * | 9/2011 | Ku | 362/231 |

(Continued)

FOREIGN PATENT DOCUMENTS

DE 202005013164 U1 11/2005

(Continued)

OTHER PUBLICATIONS

"LED Street Lights"; Apr. 1, 2007; Written by: Philip Proefrock; 18 pgs.

(Continued)

*Primary Examiner* — Peggy A. Neils
(74) *Attorney, Agent, or Firm* — Cantor Colburn LLP

(57) ABSTRACT

A method of generating light involves energizing one or more first light emitting elements thereby generating primary illumination of a first wavelength range over a target area, and energizing one or more second light emitting elements thereby generating secondary illumination of a second wavelength range toward the target area during a critical period. Both the primary illumination and the secondary illumination are combined within at least a portion of the target area thereby enhancing at least one visual property within the at least a portion of the target area.

13 Claims, 6 Drawing Sheets

U.S. PATENT DOCUMENTS

| | | | | |
|---|---|---|---|---|
| 8,061,869 | B2 | 11/2011 | Lo | |
| 8,096,685 | B2 * | 1/2012 | Lu et al. | 362/276 |
| 8,100,552 | B2 * | 1/2012 | Spero | 362/231 |
| 8,118,456 | B2 * | 2/2012 | Reed et al. | 362/311.02 |
| 8,130,099 | B2 * | 3/2012 | Steinel et al. | 340/541 |
| 8,136,969 | B2 * | 3/2012 | Burkett | 362/459 |
| 2004/0105264 | A1 | 6/2004 | Spero | |
| 2005/0047134 | A1 | 3/2005 | Mueller et al. | |
| 2005/0265023 | A1 | 12/2005 | Scholl | |
| 2006/0056169 | A1 | 3/2006 | Lodhie et al. | |
| 2006/0149607 | A1 | 7/2006 | Sayers et al. | |
| 2007/0081339 | A1 | 4/2007 | Chung et al. | |
| 2008/0043464 | A1 | 2/2008 | Ashdown | |
| 2008/0055065 | A1 | 3/2008 | Feldmeier | |
| 2008/0080178 | A1 | 4/2008 | Kita et al. | |

FOREIGN PATENT DOCUMENTS

| | | | |
|---|---|---|---|
| DE | 102005059362 | A1 | 9/2006 |
| WO | 2005072279 | A2 | 8/2005 |
| WO | 2007069185 | A1 | 6/2007 |
| WO | 2008019481 | A1 | 2/2008 |

OTHER PUBLICATIONS

LEDs Magazine—Streetlighting; "On the verge: LEDs are ready to challenge incumbent light sources in the streetlighting market"; Oct. 2006; pp. 11-13, 16 &17.

Swillas Engineering LTD; "Solar Street Lights"; 2005; 3 pgs.

English Abstract for DE202005013164U1; Publication Date: Nov. 17, 2005; 1 pg.

English Abstract for DE102005059362A1; Publication Date: Sep. 7, 2006; 1 pg.

European Search Report for Application No. 10161574.8; Date of Mailing: Sep. 8, 2010; 9 pgs.

Examiner's PTO-892 (Non-Final Office Action dated Jul. 17, 2012) for U.S. Appl. No. 13/329,803; Part of Paper No.: 20120711; 1pg.

* cited by examiner

SUSTAINABLE OUTDOOR LIGHTING SYSTEM

BACKGROUND OF THE INVENTION

The present invention relates to systems and methods for generating light, and more particularly, to systems and methods employing bi-chromatic light sources of distinct wavelength ranges for enhancing at least one visual property within at least a portion of a target area.

Outdoor lights using incandescent light bulbs have commonly been used to illuminate streets, parking lots, sidewalks, parks, and other public areas. Over the years, conventional street lights have been modified to provide functions other than illumination. For example, U.S. Pat. No. 6,624,845 to Loyd et al. discloses an apparatus mounted within a street lamp to provide surveillance using a directional antenna. However, the majority of street lights and parking lot lights still use incandescent light bulbs which result in unwanted glare, light trespass, energy waste, and sky glow. An estimated thirty percent of light generated outdoors by the aforementioned outdoor lights goes into space, flooding the skies and creating electric haze that reduces stargazing.

Many types of light sources can typically work efficiently in a narrow range of operating conditions which are governed by the physical and chemical properties of the materials used in the light source. There are only a few types of known artificial light sources such as low pressure sodium (LPS) lamps, for example, which are both highly efficient and can generate large amounts of light. While most of these types of light sources only provide quasi monochromatic light they offer utility for a number of outdoor illumination applications. Monochromatic light from LPS lamps, for example, while not enabling color rendering, can provide high visual contrast under sufficiently high illumination levels. Unfortunately, such monochromatic light is visually unappealing, with people often preferring white light generated by broadband spectral sources. Broadband spectral illumination, however, can cause undesired light pollution and environmental concerns within regions that are proximate as well as remote from the artificial night lighting.

Outdoor light fixtures incorporating light sources including incandescent, fluorescent, high-intensity discharge (HID), or LPS lamps are usually equipped with optical systems comprising reflectors, refractors, and opaque shields that redirect light or suppress unwanted light propagation. Optical systems can enable a light fixture to effectively illuminate target surfaces while reducing undesired illumination of other areas. Many highly efficient light sources such as LPS and HID lamps, however, are bulkily shaped and require large optical systems.

In addition, light pollution can be a significant concern for astronomers and conservationists. The American Astronomical Society has noted that light pollution, and in particular urban sky glow caused by directly emitted and reflected light from roadway, residential and security lighting, for example, severely impacts the ability for terrestrial astronomy.

Walker's Law is an empirical equation based on sky glow measurements which were obtained from observations of a number of Californian cities. From Walker's Law, light pollution from a city is assumed to be related linearly to the population and the inverse 2.5 power of the distance. For example, Tucson (Ariz.) has a population of 500,000 people and is located approximately 60 km from Kitt Peak National Observatory. Tucson would therefore contribute approximately 18 percent to the total sky glow at this observatory.

It has been shown that light pollution can, moreover, have detrimental environmental effects on plants and animal species, for example nocturnal mammals, migratory birds and sea turtles. For example, roadway and security lighting along the coastline of Florida has been shown to result in sometimes catastrophic reductions in the breeding success of several species of sea turtles. For example, bright lights can inhibit adult female turtles from coming ashore to lay their eggs and also lure newly hatched turtles inland rather than to the open sea.

The American Astronomical Society and the International Astronomical Union recommend several solutions for alleviating light pollution. The recommendations include controlling the emitted light via light fixture design and placement, taking advantage of timers and occupancy sensors, using ultraviolet and infrared filters to remove non-visible radiation, and using monochromatic light sources such as low-pressure sodium lamps for roadway, parking lot, and security lighting.

LPS lighting is particularly useful near astronomical observatories because the emitted light is essentially monochromatic with an emission peak at 589 nm. Narrow band rejection filters can then be used to block this region of the spectrum while allowing astronomical observations at other wavelengths. Unfortunately, LPS lamps have a number of disadvantages when used in outdoor lights. First, the LPS lamps and their light fixture housings are typically large. For example, the LuxMaster™ luminaire product series from American Electric Lighting measures from 0.75 m to 1.35 m in length for 55 W to 180 W lamps. The large anisotropic dimensions of LPS lamps can make the required light fixture optical system bulky and the device may be cost-ineffective. Furthermore, LPS lamps have poor color rendering indices (CRI) and are inferior in this regard to light sources such as high-pressure sodium (HPS) and metal halide lamps, for example. Moreover, the unnatural illumination effects resulting from LPS lamps make LPS-based roadway lighting an often undesired solution. Consequently, LPS lamps are often limited to security and parking lot lighting for industrial sites. However, light sources with better color rendering are favored whenever color discrimination is more important than energy efficiency such as for certain safety or monitoring applications, for example.

As energy costs rise and the cost of producing LEDs fall, LED lighting systems have become an ever-increasing viable alternative to the more conventional systems, such as those employing incandescent, fluorescent, and/or metal-halide bulbs. One long-felt drawback of LEDs as a practical lighting means had been the difficulty of obtaining white light from an LED. Two mechanisms have been supplied to cope with this difficulty. First, multiple monochromatic LEDs were used in combinations (such as red, green, and blue) to generate light having an overall white appearance. More recently, a single LED (typically blue) has been coated with a phosphor that emits light when activated, or "fired" by the underlying LED (also known as phosphor-conversion (PC) LEDs). This innovation has been relatively successful in achieving white light with characteristics similar to more conventional lighting, and has widely replaced the use of monochromatic LED combinations in LED lighting applications. Monochromatic LED color combinations are more commonly used in video, display or signaling applications (light to look at), as opposed to being used to illuminate an area (light to see by). As even a relatively dim light can be seen, the luminous intensity generated by LEDs in video or display applications is not a major concern.

More recently, LEDs have started to be used in high-power devices, and are no longer limited to smaller uses such as in indicator lamps. Further, LEDs are generally more energy efficient than the lighting devices traditionally used in the general illumination market. As a result, LEDs are considered an attractive alternative to traditional general lighting devices, and are encroaching on a variety of applications in the general illumination market. Light emitted from multiple LEDs having varying chromaticity can be mixed to generate white light. Despite relatively narrow emission spectra of each LED, polychromatic color mixing devices that incorporate four or more primary sources may cover the entire visible spectrum and accurately render the colors of illuminated objects. For example, an optimized quadri-chromatic red-amber-green-blue (RAGB) device has been shown to feature high values of both the general and all the special color rendering indices. Further, and notwithstanding recent advances in the field of phosphor deposition on LEDs, these devices may operate more efficiently than the phosphor-conversion white LEDs since there is no energy loss due to conversion. Additionally, these devices allow for full color control, the ability to tradeoff between qualitative characteristics (e.g. efficiency) and quantitative characteristics (e.g. color rendering, depth perception, etc.), the incorporation of internal feedback for compensation of chromaticity variations due to aging, temperature, etc., and the like, and adjustments to emitted wavelengths due to ambient light conditions, manual activation, or an automated schedule.

As a result, a need exists for an improved system and method for generating light. In particular, a need exists for a system and method that supplement primary illumination that may comprise a yellow/amber wavelength range with secondary illumination that may comprise a red wavelength range or green wavelength range. In this manner, one or more properties of the generated light may be adjusted to increase both the energy efficiency and overall lifespan of the system components while providing for an enhancement of at least one visual property during a critical period via combination of the primary and secondary illumination.

As a light source of ever increasing choice, LEDs have been packaged in numerous forms and used in lighting applications. Special control circuits have been developed to take advantage of the variability offered by the new light source and are today being offered as a solution to specific applications. In general however the design process has not zeroed in on providing the correct lighting solution. A number of LED illumination devices create "white" light by combining two or more LEDs of various wavelengths. White LEDs are also made using phosphors. The goal has not been to vary this color spectrum in real time to coordinate with the usage of the living space. The term "white" light is loosely interpreted to cover a range of illuminating light acceptable to the user for that application. HPS's yellow light has even been called white by some and the term is exclusive only of almost monochromatic sources such as LEDs and LPS lamps. The terms light spectrum, spectra, spectrum, spectral and color are used to refer to the relative spectral power distribution of the light source.

In everyday use, as dusk approaches dim twilight and nighttime darkness adversely impact our visual perception. At dusk there is poor visual contrast for driving, and our ability to accurately judge distances lessens. Also, on rainy nights, reflections from vehicles and street lights may be especially distracting. A lighting system is required that may make adjustments to the wavelengths of its emitted light in order to compensate for deficiencies in the human eye due to the specific ambient conditions. Such selection or alteration of the lighting system's emitted wavelength may provide a wide variety of other benefits in addition to improving human night vision, depth perception, and visual acuity. One such benefit may be an outdoor lighting system capable of automatically adjusting its emitted wavelengths so as not to interfere with certain light-sensitive species of animals during their respective nesting, reproduction, migration times, and the like.

A long felt need exists for a lighting system and method adapted for use in outdoor lighting situations such that the primary illumination generated by the system or method is highly energy efficient, emitted in the direction needed (reducing the amount of light lost to the sky while improving overall nighttime viewing), and augmentable with secondary illumination comprised of a distinct wavelength range, wherein such a combination of illumination sources during a critical period enhances at least one visual properties within at least a portion of the target area of the field of illumination.

This background information is provided to reveal information believed by the applicant to be of possible relevance to the present invention. No admission is necessarily intended, nor should be construed, that any of the preceding information constitutes prior art against the present invention.

BRIEF SUMMARY OF THE INVENTION

An embodiment of the invention includes a method of generating light. One or more first light emitting elements are energized thereby generating primary illumination of a first wavelength range over a target area. One or more second light emitting elements are energized thereby generating secondary illumination of a second wavelength range toward the target area during a critical period. Both the primary illumination and the secondary illumination are combined within at least a portion of the target area thereby enhancing at least one visual property within the at least a portion of the target area.

An embodiment of the invention includes a system for generating light having one or more first light emitting elements and one or more second light emitting elements. The one or more first light emitting elements are configured to generate primary illumination of a first wavelength range over a target area. The one or more second light emitting elements are configured to generate secondary illumination of a second wavelength range toward the target area during a critical period. Both the primary illumination and the secondary illumination are combinable within at least a portion of the target area thereby enhancing at least one visual property within the at least a portion of the target area.

An embodiment of the invention includes a system for generating light having one or more first light emitting diodes and one or more second light emitting diodes. The one or more first light emitting diodes are configured for generating primary illumination of a first wavelength range over a target area, wherein the first wavelength range extends from 560 nm to 610 nm. The one or more second light emitting diodes are configured for generating secondary illumination of a second wavelength range toward the target area during a critical period, wherein the second wavelength range extends from 500 nm to 550 nm or from 610 nm to 660 nm, and the critical period is defined by an event including at least one of: activation of a motion sensor, activation of an occupancy sensor, attaining a specified ambient light threshold level, manual activation, and automated activation at a preselected time interval. Both the primary illumination and the secondary illumination are combinable within at least a portion of the target area thereby enhancing at least one visual property within the at least a portion of the target area, wherein the at least one visual property includes at least one of: color temperature, color rendering, depth perception, and night vision.

DETAILED DESCRIPTION OF THE INVENTION

Although the following detailed description contains many specifics for the purposes of illustration, anyone of ordinary skill in the art will appreciate that many variations and alterations to the following details are within the scope of the invention. Accordingly, the following embodiments of the invention are set forth without any loss of generality to, and without imposing limitations upon, the claimed invention.

An embodiment of the invention, as shown and described by the various figures and accompanying text, provides an outdoor lighting system and method optimized for sustainable use and for enhancing at least one visual property within a target area. The invention may include an energy efficient primary illumination comprised of a first wavelength range wherein a secondary illumination comprised of a distinct second wavelength range may be combined thereto during critical periods to provide for enhancement of visual properties within the target area. Additionally, use of acuity tuned monochromatic light sources may greatly enhance the effectiveness and minimizing the form factor of the power generation and/or storage requirements. In this manner, color rendering, depth perception, night vision, and the like may be improved via combining the second wavelength range with the first wavelength range during at least one critical period. Dithering or minimal wavelength shifts within either one light fixture or adjacent light fixtures may further assist in augmenting visual characteristics with the target area.

Another embodiment of the invention provides monochromatic primary illumination that may be combined or augmented with one or more monochromatic secondary illumination sources to enhance both the efficiency and effectiveness of a lighting system under a range of ambient light conditions. These advantageous combination or augmentations of the various color wavelength constituents are particularly well-suited for use in connection with LED lighting systems, wherein current control means may further be incorporated.

Figure 1:
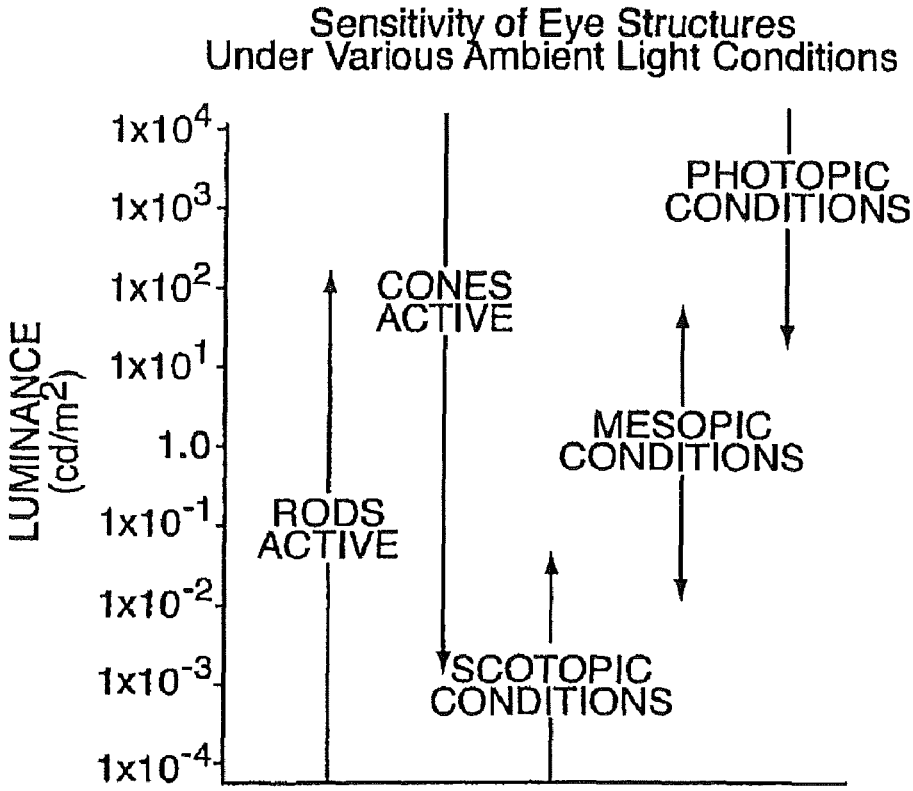
FIG. 1 illustrates the sensitivity of the human eye under various ambient light conditions.

The response of the human eye to various wavelengths of light differs depending on the ambient light conditions. This varying response is at least partially due to the two basic light-receptive structures in the eye, rods and cones. Cones tend to be more active in brightly-lit ambient conditions, whereas rods are more active in dimly-lit ambient conditions. FIG. 1 illustrates the response of the eye under a range of ambient lighting conditions. In relatively dark, or scotopic, ambient conditions, below approximately $10\times10^2$ candellas/meter squared (cd/m$^2$), the rods predominate. In relatively bright, or photopic, ambient conditions, above approximately $1.0\times10^1$ cd/m$^2$ the cones predominate. Between scotopic and photopic conditions are mesopic conditions, in which optical response is largely due to the combined response of rods and cones.

Figure 2:
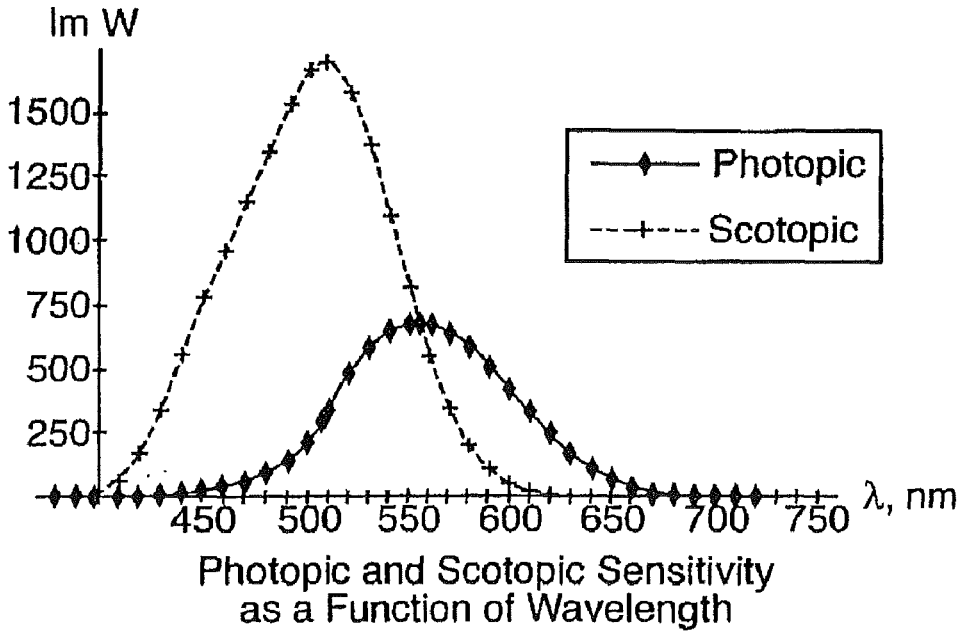
FIG. 2 illustrates the sensitivity of the human eye as a function of wavelength.

Cones are generally regarded as more sensitive to color differences whereas rods are more sensitive to the absence or presence of light. This is why animals with more acute night vision, such as cats, have eyes containing a relatively greater proportion of rods and are generally thought to be less capable of distinguishing colors. However, while the perception of color may be diminished in scotopic conditions, the rods are more sensitive to certain colors of light. The same is true of cones. As a result, the overall intensity of light perceived by the eye under both scotopic and photopic conditions is not simply a result of the intensity of the source, but also a function of the wavelength of the light produced by the source. As seen in FIG. 2, in scotopic conditions, the eye is most sensitive to light with wavelengths between approximately 450 nm to approximately 550 nm, with peak sensitivity at approximately 505 nm. In photopic conditions, the eye is most sensitive to light with wavelengths between approximately 525 nm to approximately 625 nm, with peak sensitivity at approximately 555 nm.

When the luminous intensities of variously colored LEDs is determined, this relationship is obscured, particularly with regards to scotopic effectiveness, because luminance has an inherently subjective component, as a luminance measurement is based on the photopic response of the human eye. The subjectivity of this measurement helps explain why lamps with relatively high lumen ratings, such as various sodium lamps (low-pressure sodium lamps and high-pressure sodium lamps) appear dim and harsh at night even though they possess a high lumen rating. A sodium lamp typically generates a very yellow light with a wavelength of approximately 600 nm. In dim mesopic or scotopic ambient conditions, the rods are more active, thus rendering the eye, in those conditions, less sensitive to the light being produced by the sodium lamp. Since typical nighttime outdoor lighting (pathway lighting, parking lot lighting, area lighting, and the like) are generally only designed for an intensity of approximately 0.5 cd or less, energy in such systems is largely wasted when used to produce light whose intensity will go largely unperceived by the eye due to an overly-high wavelength. Similarly, under photopic conditions, energy is less efficiently used to drive colors having relatively low wavelengths in a multi-color constituent lamp.

Preferably, one or more light emitting elements generating the primary illumination produce light having a first wavelength range at an energy efficient level for sustained light generation and one or more light emitting elements generating the secondary illumination produce light having a second wavelength range substantially corresponding to the peak scotopic sensitivity of the human eye or any other wavelength that may enhance at least visual property within the illumination target area.

Figure 3:
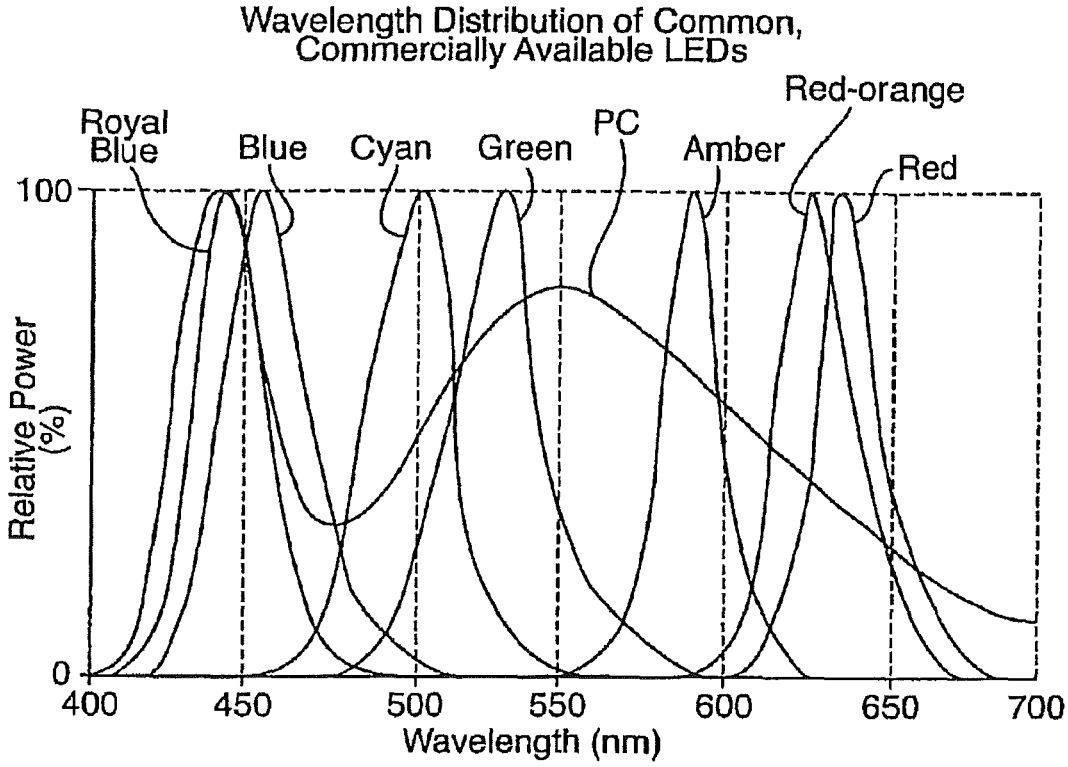
FIG. 3 illustrates the spectrums of common, commercially available LEDs.

Although monochromatic LEDs produce light only within a relatively narrow range of wavelengths (relative to incandescent lights or the sun, for instance), no existing LEDs produce only one discrete wavelength. In terms of currently-available LED colors (see FIG. 3, showing the wavelength characteristics of commonly-available LEDs), a cyan (or blue-green) LED generates light whose spectrum most closely coincides with the scotopic peak of approximately 505 nm. There is a gap in color coverage of monochromatic LEDs around the approximately 555 nm photopic peak. Green LEDs are currently, of the monochromatic LEDs, closest to the photopic peak, however the relatively broad spectrum produced by PC LEDs include wavelengths corresponding much more closely to the photopic peak. Monochromatic LEDs are the preferred choice since they require significantly less power to operate than a PC LED.

Figure 4:
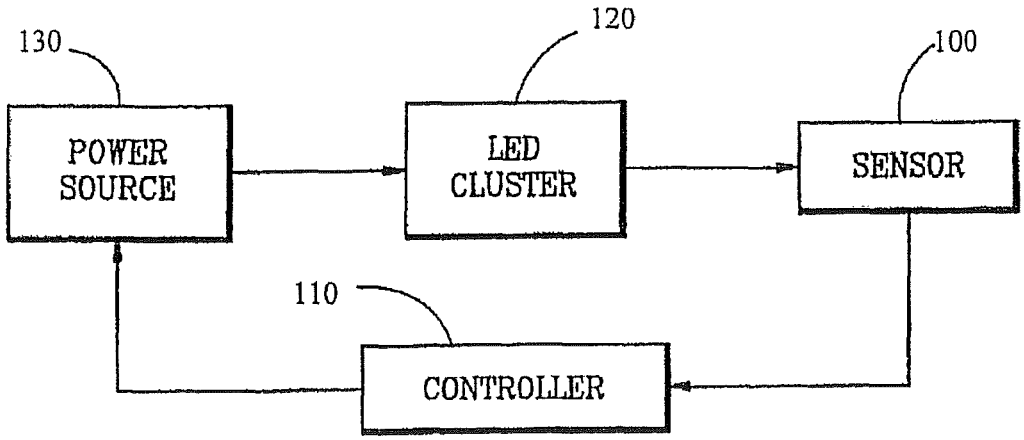
FIG. 4 illustrates a block diagram of a feedback control for maintaining the light output of an LED cluster.
Figure 10:
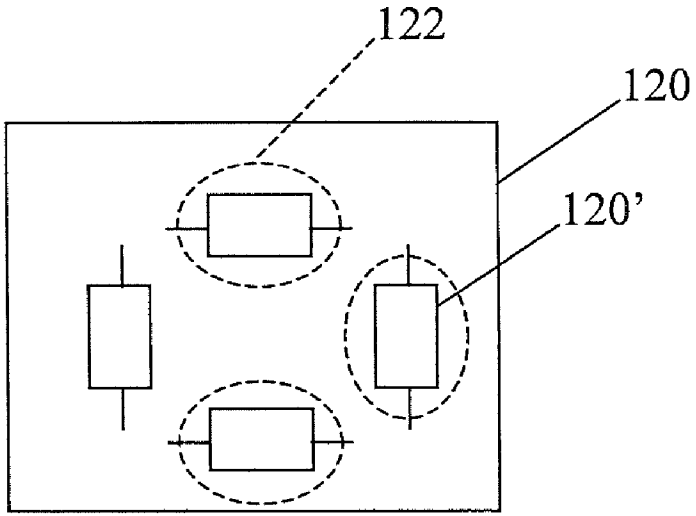
FIGS. 9 and 10 depict a block diagram schematic of LED arrangements for use as the LED cluster depicted in FIG. 4.
Figure 9:
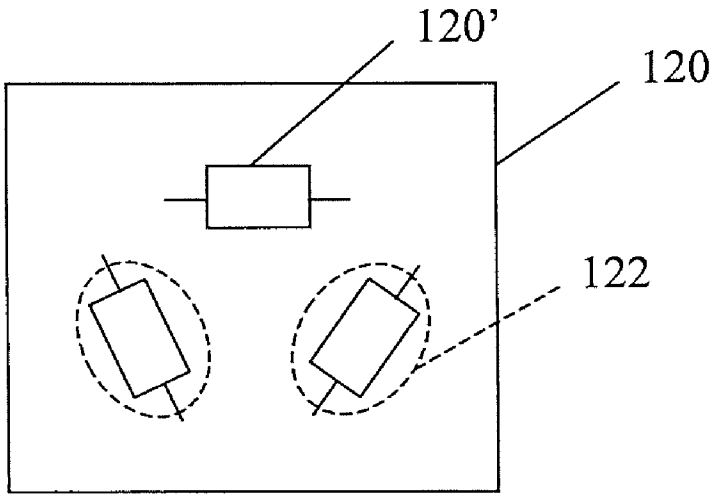

As illustrated in FIG. 4, the present invention may further comprise an ambient light sensor 100 that functions as an ambient light detection means. A programmable controller 110 may receive ambient light condition information as an input and, in scotopic (dark or night-time) conditions may perform a light adjustment routine to energize or adjust the relative intensities of the light emitting elements (e.g. LEDs 120) such that the overall spectrum of light produced by the lighting system will achieve a better scotopic response in the human eye. In an embodiment, the light emitting elements 120 include a plurality of LEDs 120', such as three or four LEDs 120' for example as illustrated in FIGS. 9 and 10, with one or more of the LEDs 120' being PC LED's having phosphor 122 disposed over the one or more LEDs 120'. In an embodiment, the phosphor 122 is provided in a hemispherical shell that encapsulates a film of high-efficiency, index-matched, semitransparent, fluorescent dye phosphor, separated from an underlying blue LED by an air gap. The adjustment may be consistently, continuously or programmably made in response to the ambient light condition, or made in response to the ambient light condition when the battery charge detector (a charge detection means, such as a voltmeter, amp-hour meter, specific gravity probe, or the like) indicates that the battery state of charge has dropped below a pre-determined threshold, or made in response to other sensing means discussed below. The system may further be in communication with a power source 130. The power source 130 may include any means known within the art including but not limited to electrical lines to a power supply company, an independent battery source, photovoltaic power sources, wind power sources, and the like. In an embodiment, sensor 100 may be an ambient light sensor as discussed above, or may be a motion sensor, an occupancy sensor, a manually activated switch, or a programmable logic controller that can be automatically activated at a preselected time interval or at preselected time intervals.

Figure 5:
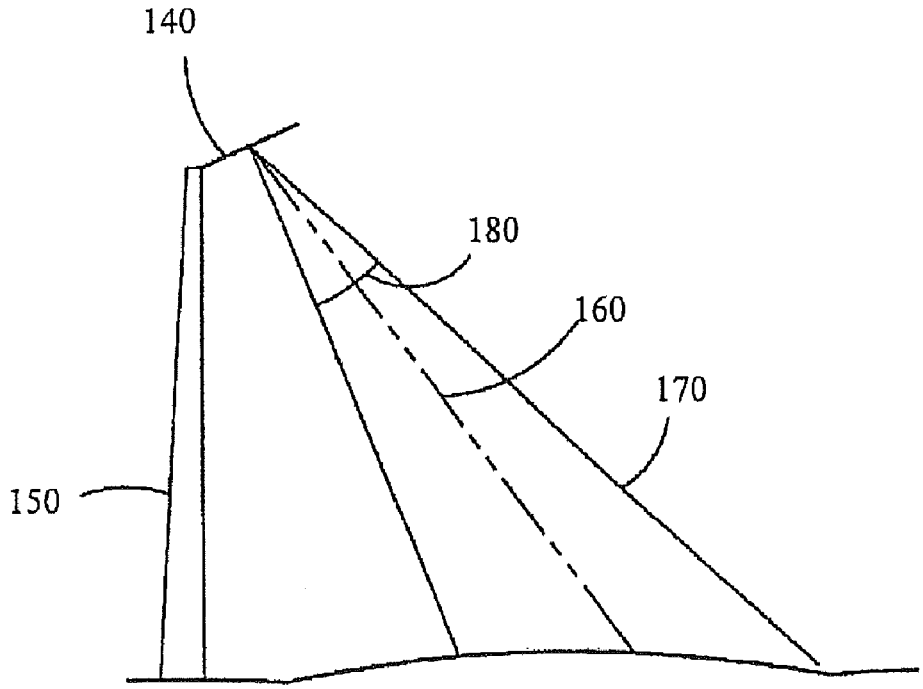
FIG. 5 depicts a side view of a target area illuminated by an embodiment of a pole mounted light source.
Figure 7:
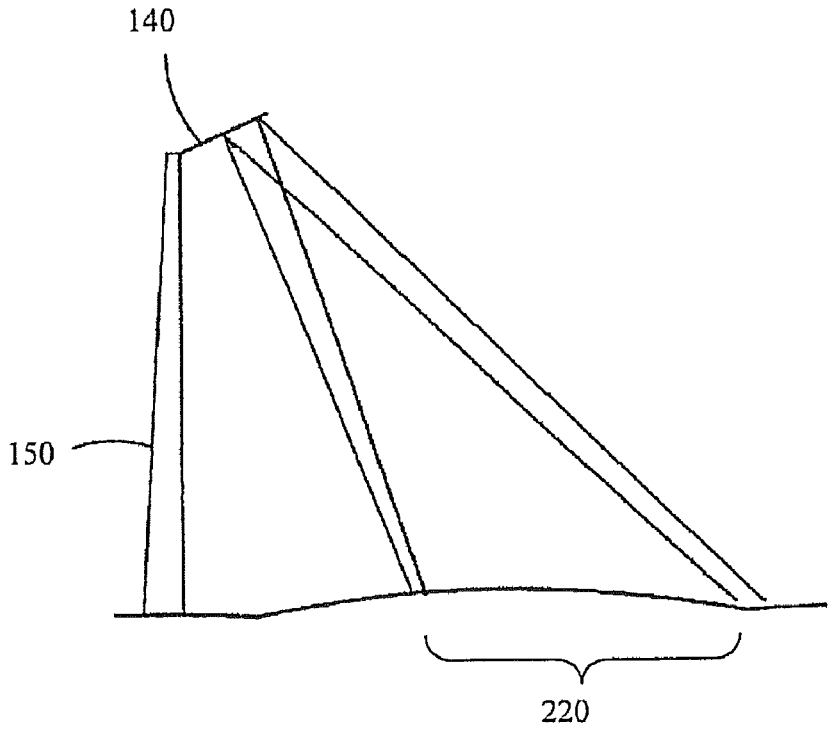
FIG. 7 depicts a side view of a target area illuminated by an embodiment of a pole mounted lighting system of the present invention.
Figure 8:
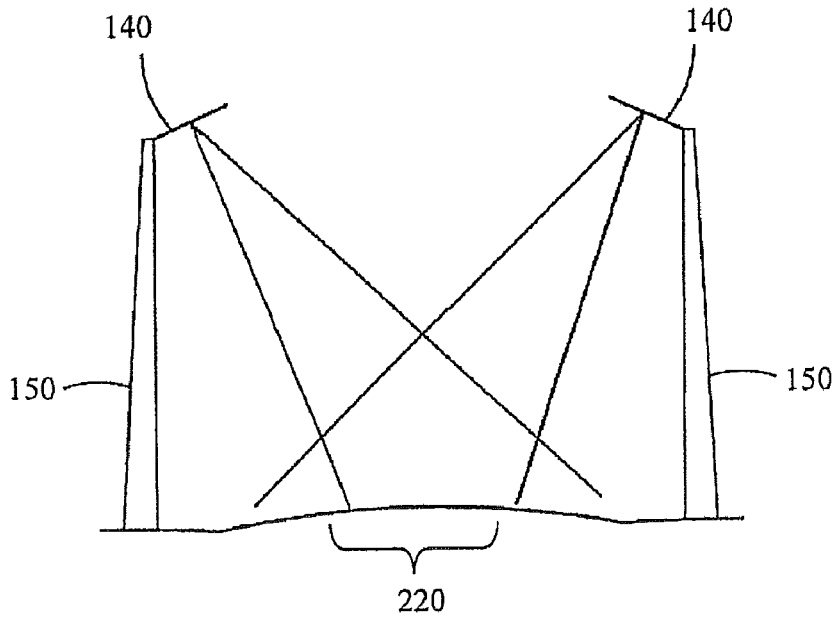
FIG. 8 depicts a side view of a target area illuminated by an embodiment of a pole mounted lighting system of the present invention.

A lighting system, more specifically, an outdoor lighting system may comprise one or more light fixtures 140 which may optionally be disposed atop a support structure 150 such as a pole, affixed to a building, wall, or fence, or disposed in other means known within the art. For the sake of clarity in the examples illustrated in FIGS. 5, 7, and 8, one or more light fixtures 140 are depicted as being disposed atop a support structure 150 (light pole). FIG. 5 depicts a typical street light that may be used in roadways, parking lots, parks, and the like. The light fixture 140 may emit light in an aiming direction which forms the axis 160 of a cone 170 with an angle 180, called a primary angle. FIG. 8 depicts the one or more light fixtures 140 as two light fixtures 140*a* and 140*b* having respective support structures 150*a* and 150*b*.

As an example of one use, present roadway lighting design codes may require that the roadway travel surface be at specific minimum illumination intensities, depending on the type of highway in question, i.e. interstate highway, secondary roadway, etc. The roadway lighting design code may also require that certain nearby surfaces other than the traveling roadway surface be illuminated with specific illumination intensities, again depending on the highway in question. Some of the nearby non-traveling surfaces usually required to be illuminated are the roadway shoulders and berm areas, and frequently the drainage ditch areas. A lighting design engineer may also desire to illuminate areas such as highway interchange in-fields for enhanced driving safety and other safety reasons. The design engineer may, therefore, be required to provide radiation and/or light patterns with significant intensity shifts from one specific area to another.

The one or more light fixtures 140 of the present invention may provide better visibility, require less power, utilize a longer lived light source, mount on standard lamp posts, reduce light pollution and emit light of various colors depending upon the selected LED, such as amber, yellow, red, green, and blue to improve at least one visual property within a target area during a critical period. In an embodiment, the critical period is defined by an event such as: activation of a motion sensor, activation of an occupancy sensor, attaining a specified ambient light threshold level, manual activation, and automated activation at a preselected time interval.

Figure 6:
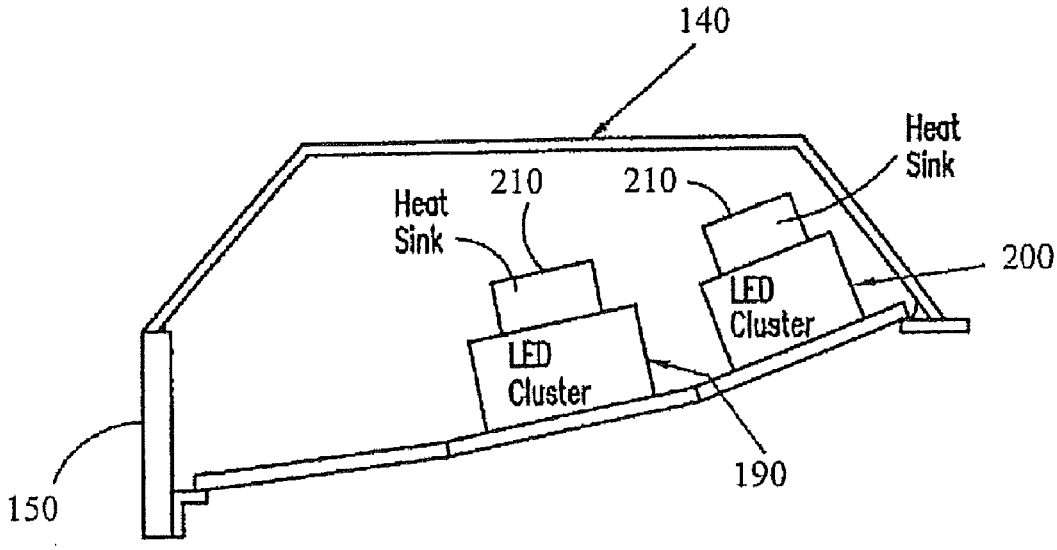
FIG. 6 depicts a cross-section view of an outdoor light fixture comprising one embodiment of the lighting system of the present invention.

As depicted in FIG. 6, the light fixture 140 may be newly manufactured or may be a pre-existing fixture having one more first light emitting elements 190 and one or more second light emitting elements 200 retrofit within the light fixture 140. The light fixture 140 is shown attached to a support structure 150. A first light source providing primary illumination may comprise one or more first light emitting elements 190. In an embodiment of the present invention the one or more first light emitting elements 190 are a cluster of light emitting elements such as light emitting diodes (LEDs) 120 disposed within the light fixture 140. A second light source providing secondary illumination may comprise one or more second light emitting elements 200. In an embodiment of the present invention the one or more second light emitting elements 200 are a cluster of light emitting elements such as light emitting diodes (LEDs) 120 disposed within the light fixture 140. In an embodiment, the one or more first light emitting elements 190 are disposed within first light fixture 140*a* (see FIG. 8), and the one or more second light emitting elements 200 are disposed with second light fixture 140*b*. In an embodiment, each cluster of LEDs 120 includes one or more phosphor-conversion LEDs, one or more monochromatic LEDs, or a combination of one or more phosphor-conversion LEDs and one or more monochromatic LEDs. In an embodiment, first light emitting elements 190 and second light emitting elements 200 may be controlled by the same controller 110 or by separate dedicated controllers 110. Each light source 190, 200 may be aimed at the same direction or at different directions toward a target area to deliver the desired lighting intensity and visual properties at the target surface area. Each light source 190, 200 may include a heat dissipating element 210 such as a heat sink which may be attached using heat transmissive material or any other means known within the art. The number of individual light emitting elements 190, 200 may be determined by the amount of light available from each cluster, the height of the light fixture 140, the area of the target to be illuminated, the amount of light desired on the target area, the contour of the target area and several other factors.

The selection of the wavelength range colors according to the present invention tales into account that the human eye has its greatest sensitivity in the visual spectrum at approximately 555 nm is photopic conditions and approximately 505 nm in scotopic conditions. As representatively shown in FIG. 2, high transmission in the yellow/amber wavelength range may begin at approximately 550 nm and extend to approximately 610 nm. Visual acuity may be heightened by the addition of light within the green wavelength range. The green wavelength range may extend from approximately 500 nm to 550 nm, with an optimal peak of approximately 525 nm. Night vision may be heightened by the addition of light within the red wavelength range. The red wavelength range may extend from approximately 610 nm to 660 nm, with an optimal peak of approximately 640 nm.

As shown in FIG. 6, the light generation system of the present invention may comprise one or more first light emitting elements 190 and one or more second light emitting elements 200 disposed within a light fixture 140. Each of the light emitting elements 190, 200 may comprise one or more phosphor-conversion LEDs, one or more monochromatic LEDs, an incandescent light bulb, a gas discharge tube, or a fluorescent tube, and preferably comprise one or more LEDs. In operation, the primary illumination generated by the one or more first light emitting elements 190 is combined with the secondary illumination generated by the one or more second light emitting elements 200 to produce light that improves at least one visual property within a target area during at least a critical period.

Various aspects of the invention will be further discussed with reference to an illustrative embodiment in which the one or more first light emitting elements 190 comprises monochromatic light emitting diodes generating light within the same range, a first wavelength range. In an embodiment, the first wavelength range comprises the yellow/amber wavelength range (a range that extends from 560 nm to 610 nm, for example). In typical use, only the one or more first light emitting elements 190 need be energized to generate sufficient light for a target area. However, during a critical time, such as when a vehicle approaches a roadway intersection, one or more second light emitting elements 200 may be energized to generate light within a second wavelength range. The second wavelength range may be that of any spectral color, however, in an embodiment the second wavelength range may comprise the green or red spectral color ranges (a range that extends from 500 nm to 550 nm, or from 610 nm to 660 nm, for example). It is understood, however, that this configuration is only illustrative, and various alternative lighting configurations may be used. In operation, the one or more first light emitting elements 190 alone are a vast majority of the time to provide for energy efficient lighting of a target area. During a critical period, the one or more second light emitting elements 200 are energized and the light of the second wavelength range combines with the light of the first wavelength range. Such combination allows the light of the second wavelength range to enhance at least one visual property for a human eye within at least a portion of the target area. In an embodiment, the at least one visual property includes color temperature, color rendering, depth perception, and night vision.

In this manner, visual acuity, night vision, color rendering, color temperature, depth perception, and the like may be enhanced within at least a portion of the target area during a critical period.

Figure 11:
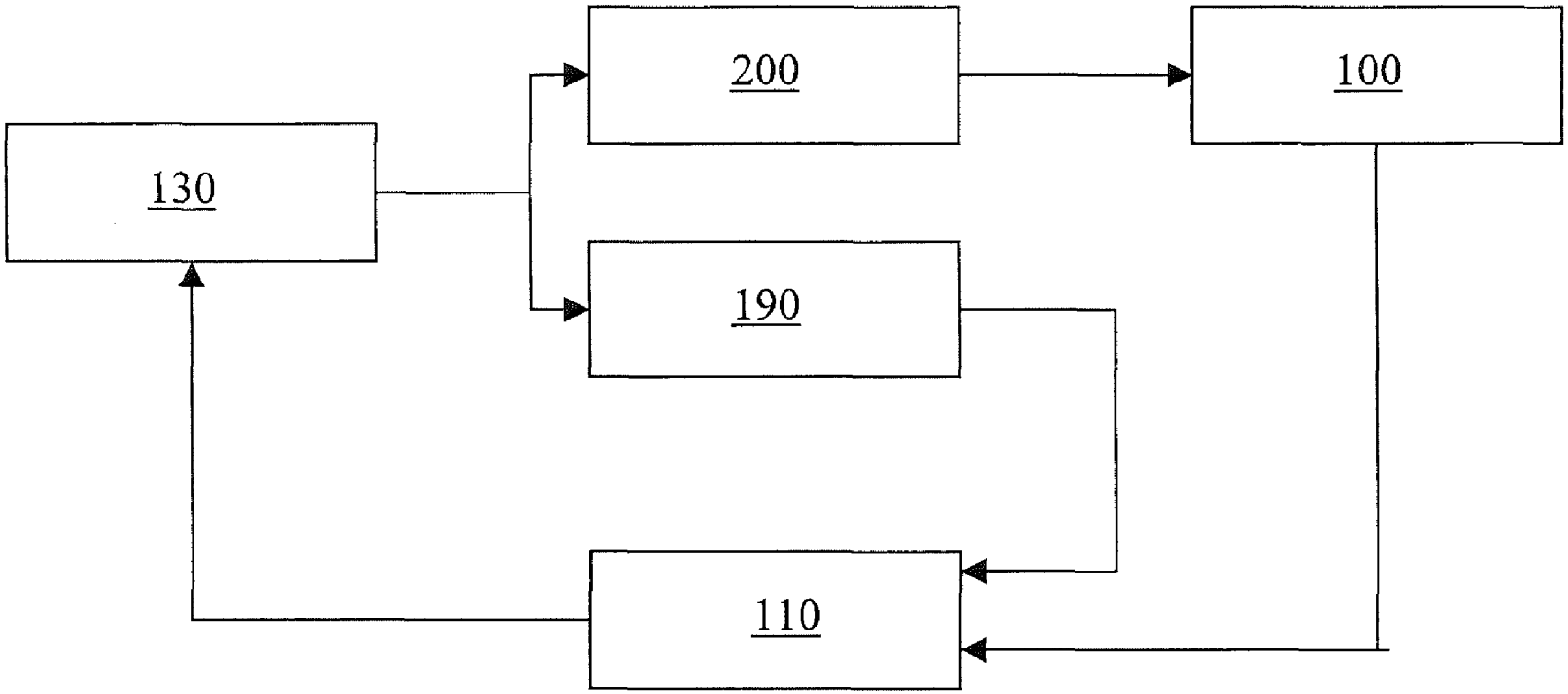
FIG. 11 depicts an alternate block diagram control scheme to that of FIG. 4.

Reference is now made to FIG. 11, which depicts a similar control scheme as that depicted in FIG. 4, but with two LED clusters 190, 200 (depicted in FIG. 4 as a single cluster 120), with each cluster 190, 200 comprising LED clusters 120 as depicted in FIGS. 9 and 10 for example. Here, the first LED cluster 190 provides primary illumination absent control via the sensor 100, and the secondary cluster 200 provides secondary illumination with control via the sensor 100, thereby enabling primary and secondary illumination control schemes as disclosed herein. For example, during a non-critical time period, controller 110 sends a signal to power source 130 to provide power to only first LED cluster 190, and during a critical time period, sensor 100 signals controller 110 to send a signal to power source 130 to provide power to both first and second LED clusters 190, 200. While the foregoing control scheme in relation to the illustration of FIG. 11 describes a specific arrangement, it will be appreciated by one skilled in the art that other control schemes may be equivalent in function and performance and are therefore considered within the scope of the invention disclosed herein.

It is an aspect of the present invention to provide an area lighting system and method that may retro-fit existing poles and the like without exceeding the existing lamp projected surface area thereby staying within the design wind load of the existing poles.

It is another aspect of the present invention to provide an area lighting system and method providing a light output that minimizes the occurrence of light pollution, generation of confusing driving conditions due to confusing night time lighting patterns, light trespass, glare, energy waste, high maintenance cost and contribution to urban sky glow.

It is another aspect of the present invention to provide an area lighting system that may act as an efficient, low maintenance and substantial power saving substitute for now widely used incandescent light bulbs for illumination of streets, parking lots and other public areas, requiring minimal wiring modification to the conventional streetlight or parking lot housings.

It is another aspect of the present invention to provide an area lighting system that emanates a highly energy efficient first wavelength range of light which may be supplemented with a second wavelength range of light to improve at least one visual property while at the same time reducing overall light pollution. In an embodiment, the wavelength ranges comprise yellow/amber, red, and green, but wavelength ranges including orange, cool white, and blue colors may also be used and herein are contemplated.

It is another aspect of the invention to provide an area lighting system and method for generating white light. In particular, primary illumination comprising a first wavelength range may be supplemented with secondary illumination of a second wavelength range during a critical period. The first wavelength range may comprise the yellow/amber wavelength range thereby providing highly energy efficient primary illumination similar to the conventional LPS or HPS lighting. The second wavelength range may comprise the red or green wavelength ranges. During a critical period, the secondary illumination may be energized and combined with the primary illumination resulting in an improvement in at least one visual property, such as color temperature, color rendering, depth perception and the like. By adjusting the wavelength range of the secondary illumination, specific desired visual attributes may be enhanced during required periods while primary illumination of a monochromatic nature may provide energy efficient lighting outside of any critical period. As a result, the invention provides a system and method of energy efficient illumination that can be incorporated into various lighting applications, and has an extended life when one or more light emitting diodes are used to generate the first and second wavelengths, respectively.

Some of the illustrative aspects of the present invention may be advantageous in solving the problems herein described and other problems not discussed which are discoverable by a skilled artisan.

While the above description contains much specificity, these should not be construed as limitations on the scope of any embodiment, but as exemplifications of the presented embodiments thereof. Many other ramifications and variations are possible within the teachings of the various embodiments. While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the scope of the appended claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

Thus the scope of the invention should be determined by the appended claims and their legal equivalents, and not by the examples given.

What is claimed is:

1. A method of generating street light, the method comprising:

utilizing a sensor disposed in signal communication with a controller to determine whether a critical time period exists, the critical time period being when a vehicle approaches a roadway intersection;

determining whether a non-critical time period exists utilizing a controller, the non-critical time period being a time period other than the critical time period;

if the controller determines that a non-critical time period exists, then energizing one or more first light emitting elements thereby generating primary illumination of a first wavelength range over a target area of the street utilizing the controller, the first wavelength range extending from 560 nm to 610 nm; and if the controller via the sensor has determined that a critical period exists, then both energizing one or more second light emitting elements thereby generating secondary illumination of a second wavelength range toward the target area of the street, the second wavelength range extending from either 500 nm to 550 nm or from 610 nm to 660 nm, and energizing the one or more first light emitting elements thereby generating the primary illumination of the first wavelength range over the target area utilizing the controller, such that both the primary illumination and the secondary illumination are combined within at least a portion of the target area of the street thereby enhancing at least one visual property within the at least a portion of the target area of the street during the critical time period.

2. The method of claim 1, wherein the at least one visual property comprises at least one of: color temperature, color rendering, depth perception, and night vision.

3. The method of claim 1, wherein the one or more first light emitting elements and the one or more second light emitting elements are disposed within a first light fixture.

4. The method of claim 1, wherein the one or more first light emitting elements are disposed within a first light fixture and the one or more second light emitting elements are disposed within a second light fixture.

5. The method of claim 1, wherein the one or more first light emitting elements comprise one or more light emitting diodes emitting the first wavelength range and the one or more second light emitting elements comprise one or more light emitting diodes emitting the second wavelength range.

6. The method of claim 5, wherein the one or more first light emitting diodes and the one or more second light emitting diodes each comprise at least one of one or more phosphor-conversion light emitting diodes and one or more monochromatic light emitting diodes.

7. A system for generating street light, the system comprising:

a sensor configured to determine whether a critical time period or a non-critical time period exists, the critical time period being when a vehicle approaches a roadway intersection, the non-critical time period being a time period other than the critical time period;

a controller disposed in signal communication with the sensor and configured to determine whether the sensor is activated, activation of the sensor being indicative of the existence of a critical time period;

if the sensor is not activated, then the controller is configured to generate a signal to induce one or more first light emitting elements to generate primary illumination of a first wavelength range over a target area of the street, the first wavelength range extending from 560 nm to 610 nm; and if the sensor is activated indicating a critical time period, then the controller is further configured to generate another signal to induce one or more second light emitting elements to generate secondary illumination of a second wavelength range toward the target area of the street, the second wavelength range extending from either 500 nm to 550 nm or from 610 nm to 660 nm, and to induce the one or more first light emitting elements to generate the primary illumination of the first wavelength range over the target area of the street, such that the primary illumination and the secondary illumination are combinable within at least a portion of the target area of the street thereby enhancing at least one visual property within the at least a portion of the target area of the street during the critical time period.

8. The system of claim 7, wherein the at least one visual property comprises at least one of: color temperature, color rendering, depth perception, and night vision.

9. The system of claim 7, wherein the one or more first light emitting elements and the one or more second light emitting elements are disposed within a first light fixture.

10. The system of claim 7, wherein the one or more first light emitting elements are disposed within a first light fixture and the one or more second light emitting elements are disposed within a second light fixture.

11. The system of claim 7, wherein the one or more first light emitting elements comprise one or more light emitting diodes emitting the first wavelength range and the one or more second light emitting elements comprise one or more light emitting diodes emitting the second wavelength range.

12. The system of claim 11, wherein the one or more first light emitting elements and the one or more second light emitting element each comprise at least one of: one or more phosphor-conversion light emitting diodes and one or more monochromatic light emitting diodes.

13. The method of claim 1, wherein when both the primary illumination and the secondary illumination are combined, the at least one visual property is enhanced under scotopic conditions within the at least a portion of the target area of the street.

* * * * *

UNITED STATES PATENT AND TRADEMARK OFFICE

CERTIFICATE OF CORRECTION

PATENT NO. : 8,308,318 B2
APPLICATION NO. : 12/434417
DATED : November 13, 2012
INVENTOR(S) : Fredric S. Maxik It is certified that error appears in the above-identified patent and that said Letters Patent is hereby corrected as shown below:

On the Title Page:

Item (73) in column 1, line 2, delete "Westampton, NJ (US)" and insert -- Satellite Beach, FL (US) --, therefor.

In the Specification:

In column 6, line 9, delete "$10\times10^{2}$" and insert -- $1.0\times10^{2}$ --, therefor.

In column 6, line 9, delete "candellas/" and insert -- candelas/ --, therefor.

In the Claims:

In column 12, line 18, In Claim 6, after "one" delete "of" and insert -- of: --, therefor.

Signed and Sealed this
Eighth Day of July, 2014

Michelle K. Lee

Michelle K. Lee
*Deputy Director of the United States Patent and Trademark Office*